US006077648A

United States Patent [19]

Nair et al.

[11] Patent Number: 6,077,648

[45] Date of Patent: Jun. 20, 2000

[54] PROTECTIVE OVERCOAT FOR PHOTOGRAPHIC ELEMENTS

[75] Inventors: Mridula Nair, Penfield; Tamara K. Jones, Rochester; Lloyd A. Lobo, Webster; Brian A. Schell, Honeoye Falls, all of N.Y.

[73] Assignee: Eastman Kodak Company, Rochester, N.Y.

[21] Appl. No.: 09/235,436

[22] Filed: Jan. 22, 1999

[51] Int. Cl.[7] ..... G03C 5/29; G03C 1/76; G03C 11/06

[52] U.S. Cl. ..... 430/350; 430/512; 430/527; 430/531; 430/536; 430/961

[58] Field of Search ..... 430/531, 536, 430/961, 350, 512, 527

[56] References Cited

U.S. PATENT DOCUMENTS

| | | | |
|---|---|---|---|
| 2,173,480 | 9/1939 | Jung . | |
| 2,259,009 | 10/1941 | Talbot . | |
| 2,331,746 | 10/1943 | Talbot . | |
| 2,706,686 | 4/1955 | Hilborn . | |
| 2,798,004 | 7/1957 | Weigel . | |
| 3,113,867 | 12/1963 | VanNorman et al. . | |
| 3,190,197 | 6/1965 | Pinder . | |
| 3,397,980 | 8/1968 | Stone . | |
| 3,415,670 | 12/1968 | McDonald . | |
| 3,443,946 | 5/1969 | Grabbafer et al. . | |
| 3,697,277 | 10/1972 | King | 430/961 |
| 3,733,293 | 5/1973 | Gallagher et al. . | |
| 4,092,173 | 5/1978 | Novak et al. . | |
| 4,171,979 | 10/1979 | Novak et al. . | |
| 4,333,998 | 6/1982 | Leszyk | 430/531 |
| 4,426,431 | 1/1984 | Harasta et al. | 430/536 |
| 4,999,266 | 3/1991 | Platzer et al. | 430/14 |
| 5,179,147 | 1/1993 | Jones . | |
| 5,376,434 | 12/1994 | Ogawa et al. | 430/935 |
| 5,447,832 | 9/1995 | Wang et al. | 430/527 |
| 5,695,920 | 12/1997 | Anderson et al. | 430/531 |
| 5,804,360 | 9/1998 | Schell et al. | 430/531 |
| 5,853,926 | 12/1998 | Bohan et al. | 430/531 |

*Primary Examiner*—Richard L. Schilling
*Attorney, Agent, or Firm*—Carl F. Ruoff

[57] ABSTRACT

The present invention is a photographic element which includes a support, at least one silver halide emulsion layer superposed on the support and a processing solution permeable protective overcoat overlying the silver halide emulsion layer. The processing solution permeable overcoat is composed of a urethane-vinyl copolymer having acid functionalities wherein a weight ratio of the urethane in the copolymer comprises from 20 to 100 percent and a weight ratio of the vinyl in the copolymer comprises from 0 to 80 percent. The present invention is a method of making a photographic element which includes providing an photographic element having a support, a silver halide emulsion layer superposed on the support and a processing solution permeable protective overcoat overlying the silver halide emulsion layer. The processing solution permeable overcoat is composed of a urethane-vinyl copolymer having acid functionalities wherein a weight ratio of the urethane in the polymer comprises from 20 to 100 percent and a weight ratio of the vinyl in the polymer comprises from 0 to 80 percent. The photographic element is developed in a developer solution having a pH greater than 7 and the processing solution permeable overcoat is fused.

11 Claims, No Drawings

PROTECTIVE OVERCOAT FOR PHOTOGRAPHIC ELEMENTS

CROSS REFERENCE TO RELATED APPLICATIONS

This application relates to commonly assigned copending application Ser. No. 09/235,437, filed simultaneously and incorporated by reference herewith.

FIELD OF THE INVENTION

The present invention relates to photographic elements having a protective overcoat, that resists fingerprints and scratches. More particularly, the present invention provides a processing solution permeable protective overcoat.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, fingerprints can easily mark the imaged element, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. The application of UV-polymerizable monomers and oligomers on processed image followed by radiation exposure to form crosslinked protective layer is described U.S. Pat. Nos. 4,092,173, 4,171,979, 4,333,998 and 4,426,431. One drawback for the solvent coating method and the radiation cure method is the health and environmental concern of those chemicals to the coating operator. The other drawback is that these materials need to be coated after the processing step. Thus, the processing equipment needs to be modified as well as the personnel running the processing operation need to be trained. In addition, several lamination techniques are known and practiced in the trade. U.S. Pat. Nos. 3,397,980, 3,697,277 and 4,999,266 describe methods of laminating polymeric sheet film on the processed image as the protective layer. U.S. Pat. No. 5,447,832 describes the use of a protective layer containing a mixture of high and low Tg latices as the water-resistant layer to preserve the antistat property of the $V_2O_5$ layer through photographic processing. This protective layer is not applicable to the image formation layers since it will detrimentally inhibit the photographic processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective. However, all these techniques need to be carried out after the image has been formed, which adds a large cost to the final imaged product.

Thus, the ability to provide the desired property of post-process water/stain resistance of the imaged photographic element, at the point of manufacture of the photographic element, is a highly desired feature. However, in order to accomplish this feature, the desired photographic element should be permeable to aqueous solutions during the processing step, but achieve water impermeability after processing, without having to apply additional chemicals or to substantially change the chemicals used in the processing operation.

Therefore there remains a need for a water-resistant protective overcoat that can be incorporated into an imaging element, which at the same time allows for uninhibited diffusion of photographic processing solutions, and which is impermeable or if necessary can then be made further impermeable to aqueous solutions after exposure and processing.

SUMMARY OF THE INVENTION

The present invention is a photographic element which includes a support, at least one silver halide emulsion layer superposed on the support and a processing solution permeable protective overcoat overlying the silver halide emulsion layer. The processing solution permeable overcoat is composed of a urethane-vinyl copolymer having acid functionalities. The weight ratio of the urethane component in the copolymer can vary from 20 to 100 percent. The weight ratio of the vinyl component in the copolymer can vary from 0 to 80 percent.

The present invention is a method of making a photographic element which includes providing an photographic element having a support, a silver halide emulsion layer superposed on the support and a processing solution permeable protective overcoat overlying the silver halide emulsion layer. The processing solution permeable overcoat is composed of a urethane-vinyl copolymer having acid functionalities. The weight ratio of the urethane component in the polymer can vary from 20 to 100 percent. The weight ratio of the vinyl component in the polymer can vary from 0 to 80 percent. The photographic element is developed in a developer solution having a pH greater than 7 and the processing solution permeable overcoat is fused.

DESCRIPTION OF THE PREFERRED EMBODIMENTS

The present invention provides a simple and inexpensive way to improve the water-resistance of imaging elements and to improve resistance to abrasion and fingerprinting while maintaining processability. In accordance with this invention, a protective overcoat is applied over the imaging element prior to exposure and processing. In a particular embodiment, a continuous protective overcoat is applied over a photographic element having at least one silver halide light-sensitive emulsion layer; and comprises a pH switchable polymer such that it allows excellent permeability of the developer solution at pH greater than 7 and development of the silver halide light sensitive emulsion layer to provide an imaged photographic element. The polymer overcoat is then further coalesced by fusing (heat and/or pressure) if needed after processing without substantial change or addition of chemicals in the processing step to form a fully water impermeable protective overcoat with excellent gloss characteristics. Fusing is preferably done at a temperature of from 25 to 200° C. Polymers used in the practice of this invention are urethane polymers, preferably urethane-vinyl copolymers containing pH responsive groups such as acid functionalities, most preferably urethane-acrylic copolymers having an acid number greater than or equal to 5 and less than or equal to 30, preferably from 10 to 25, most preferably 12 to 20. The weight ratio of the urethane component in the polymer can vary from 20 to 100 percent. The weight ratio of the vinyl component in the polymer can vary from 0 to 80 percent. In accordance with the present invention, a photographic element comprises a support having thereon at least one light-sensitive layer and coated over the light sensitive layer furthest from the support a continuous layer of polymer having an acid number less than or equal to 30 but greater than or equal to 5 and permeable to water only at pH of greater than 7.

The present invention provides a novel overcoat formulation to the emulsion side of photographic products, particularly photographic prints, which encounter frequent handling and abuse by end users. The overcoat formulation of the present invention is derived from urethane polymers, preferably urethane-vinyl copolymer dispersions. Polyurethanes provide advantageous properties such as good film-formation, good chemical resistance, abrasion-resistance, toughness, elasticity and durability. Further, urethanes exhibit high levels of tensile and flexural strength, good abrasion resistance and resistance to various oils. Vinyls, especially acrylics have the added advantage of good adhesion, non-yellowing, are adjustable for high gloss and have a wide range of glass transition and minimum film forming temperatures. The urethane-vinyl hybrid polymers (copolymers) are very different from mere blends of the two. Polymerization of the vinyl monomer in the presence of the polyurethane causes the two polymers to reside in the same latex particle as an interpenetrating or semi-interpenetrating network or as a core shell particle resulting in improved resistance to water, organic solvents and environmental conditions, improved tensile strength and modulus of elasticity. The presence of groups such as carboxylic acid groups provide a conduit for processing solutions to permeate the coating at pH greater than 7. Maintaining the acid number of less than or equal to 30 ensures that overcoat has good adhesion to the substrate below, even at high pH and makes the overcoat more water-resistant. The overcoat layer in accordance with this invention is particularly advantageous due to superior physical properties including excellent resistance to water permeability, fingerprinting, fading and yellowing, exceptional transparency and toughness necessary for providing resistance to scratches, abrasion, blocking, and ferrotyping.

The support material used with this invention can comprise various polymeric films, papers, glass, and the like. The thickness of the support is not critical. Support thicknesses of 2 to 15 mils (0.002 to 0.015 inches) can be used.

Coating compositions for forming the protective overcoat layer in accordance with the present invention comprise a continuous aqueous phase having therein a film forming binder, wherein the binder comprises hybrid urethane-vinyl copolymer having an acid number of greater than or equal to 5 and less than or equal to 30. Acid number is in general determined by titration and is defined as the number of milligrams of potassium hydroxide (KOH) required to neutralize 1 gram of the polymer.

The polymer overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer, dyes that will impart color. In addition, additives can be incorporated into the polymer that will give to the overcoat desired properties. For example, a UV absorber can be incorporated into the polymer to make the overcoat UV absorptive, thus protecting the image from UV induced fading. Other additional compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is fused. For example, in contact fusing the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The preparation of aqueous polyurethane dispersions is well known in the art. In all cases, the first step is the formation of a medium molecular weight isocyanate terminated prepolymer by the reaction of suitable di or polyol with a stoichiometric excess of di or polyisocyanates. The prepolymer is then generally dispersed in water via water-solubilizing/dispersing groups, which are, introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane. When the vinyl component is present in the copolymer, the urethane-vinyl copolymers are produced by polymerizing one or more vinyl monomers in the presence of the polyurethane prepolymer or the chain extended polyurethane, the preferred weight ratio of the chain extended polyurethane to the vinyl monomer being about 4:1 to about 1:4, most preferably about 1:1 to 1:4.

Polyols useful for the preparation of polyurethane dispersions of the present invention include polyester polyol prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. A polyester polyol is preferred for the present invention.

Polyisocyanates useful for making the prepolymer may be aliphatic, aromatic or araliphatic. Examples of suitable polyisocyanates include one or more of the following: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate, polymethylene polypheyl polyisocyanates, and the like. Methylene bis(isocyanato cyclohexane) is preferred.

A suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and dispersibility in water. Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an $\alpha,\alpha$-dimethylolalkanoic acid, especially 2,2-dimethylol propionic acid.

Suitable tertiary amines that are used to neutralize the acid and form anionic groups for water dispersability are trimethylamine, triethylamine, dimethylaniline, diethylaniline, triphenylamine and the like.

Chain extenders suitable for chain extending the prepolymer are active-hydrogen containing molecules such as polyols, amino alcohols, ammonia, primary or secondary aliphatic, aromatic, alicyclic, araliphatic or heterocyclic amines especially diamines. Diamines suitable for chain extension of the pre-polyurethane include ethylenediamine, diaminopropane, hexamethylene diamine, hydrazine, aminoethyl ethanolamine and the like.

In accordance with a critical feature of this invention a hybrid urethane-vinyl copolymer is prepared by polymerizing vinyl addition monomers in the presence of the polyurethane prepolymer or the chain extended polyurethane. The solution of the water-dispersible polyurethane prepolymer in vinyl monomer may be produced by dissolving the prepolymer in one or more vinyl monomers before dispersing the prepolymer in water.

Suitable vinyl monomers in which the prepolymer may be dissolved contain one or more polymerizable ethylenically unsaturated groups. Preferred monomers are liquid under the temperature conditions of prepolymer formation although the possibility of using solid monomers in conjunction with organic solvents is not excluded.

The vinyl polymers useful for the present invention include those obtained by interpolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, and diacrylates of alkyl diols such as butanediol diacrylate and hexanediol diacrylate, divinyl benzene and the like.

The prepolymer/vinyl monomer solution may be dispersed in water using techniques well known in the art. Preferably, the solution is added to water with agitation or, alternatively, water may be stirred into the solution. Polymerization of the vinyl monomer or monomers is brought about by free radical initiators at elevated temperatures.

Free radicals of any sort may be used including persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron(II) salt, potassium persulfate-sodium hydrogen sulfate, etc.). Preferable free radical initiators are the ones that partition preferably into the oil phase such as the azo-type initiators. Common chain transfer agents or mixtures thereof known in the art, such as alkylmercaptans, can be used to control the polymer molecular weight.

Polymerization may be carried out by one of two methods. In the first method, all of the vinyl monomer (the same or different vinyl monomers or monomer mixtures) is added in order to swell the polyurethane pre-polymer. The monomers are then polymerized using an oil soluble free radical initiator after dispersing the mixture in water.

In the second method, some of vinyl monomer may be added to swell the pre-polymer prior to dispersing in water. The rest of the monomer is fed into the system during the polymerization process.

In either method of polymerization, the vinyl monomers, which may be added and polymerized, include those mentioned above. Functional monomers such as hydroxyalkyl acrylates and methacrylates may also be incorporated at this stage since the free isocyanate groups of the prepolymer will have reacted with the chain extender.

Some examples of urethane acrylic copolymers used in the practice of this invention that are commercially available are the NeoPac R-9000, R-9699 and R-9030 from Zeneca Resins, the SancureAU4010 from BF Goodrich, and the Flexthane 620, 630, 790 and 791 from Air Products. An example of the urethane polymer useful in the practice that is commercially available is the NeoRez R9679.

Optionally, the coating composition in accordance with the invention may also contain suitable crosslinking agents. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used, as this will decrease the permeability of the processing solution by lowering the acid number. The preferred crosslinker is a polyfunctional aziridine crosslinker.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the urethane-vinyl copolymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth) acrylamides containing perfluoroalkyl side groups, and the like. Lubricants useful in the present invention are described in further detail in *Research Disclosure* No.308119, published December 1989, page 1006.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008.

The photographic elements in which the images to be protected can contain conductive layers. Conductive layers can be incorporated into multilayer imaging elements in any of various configurations depending upon the requirements of the specific imaging element. Preferably, the conductive layer is present as a subbing or tie layer underlying a magnetic recording layer on the side of the support opposite the imaging layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the imaging layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an imaging element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the imaging layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of paper or the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

The photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged photographic elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

The photographic elements in which the images to be protected are formed can have the structures and components shown in Research Disclosures 37038 and 38957. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. Nos. 4,279,945 and 4,302,523.

Suitable silver halide emulsions and their preparation, as well as methods of chemical and spectral sensitization, are described in Sections I through V of Research Disclosures 37038 and 38957. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The present invention is illustrated by the following examples:

Synthesis of Polymer P1

Into a dry reactor was charged 96 grams of a diol (Millester 9-55, MW2000 from Polyurethane Corporation of America), 87 grams of the methylene bis(4-cyclohexyl) isocyanate (Desmodur W) and 0.02 grams of dibutyltin dilaurate (Aldrich) and the mixture was held with stirring for 30 minutes at 94° C. after which 12 grams of N-methyl pyrrolidone were added. After another 30 minutes 14 grams of dimethylol propionic acid and 12 grams of N-methyl pyrrolidone were added to the reactor and the mixture stirred for 2.5 hours at 94° C. The resultant prepolymer was cooled to room temperature, dissolved in a vinyl monomer mixture of 113 grams of n-butyl acrylate, 212 grams of methyl methacrylate and 1.5 grams of hexanediol diacrylate and then treated with 11 grams of triethylamine. This solution was added slowly with stirring to another reactor containing 662 grams of distilled water at 25° C. under nitrogen. A solution of 1.48 grams of initiator (AIBN) dissolved in 8.4 grams of N-methyl pyrrolidone was added to the reactor followed by 10 grams of ethylene diamine in 20 grams of water. The dispersion was heated to 65° C. and held there with stirring for 10 hours. The resulting dispersion of the urethane acrylic copolymer was used as polymer P1 having an acid number of 11.

Synthesis of Polymer P2

Polymer P2 was synthesized in a manner similar to P1 except that dimethylol propionic acid was increased to 19.5 grams to give an acid number of 15.

Synthesis of Polymer P3

Polymer P3 was synthesized in a manner similar to P2 except that the diol was changed to Millester 16-55 (MW2000 from Polyurethane Corporation of America).

All the protective overcoats were coated over paper that was previously coated with light sensitive emulsions in a formulation described below. The gelatin containing layers were hardened with bis(vinylsulfonyl methyl) ether at 1.95% of the total gelatin weight.

| Layer | Laydown (g/m$^2$) |
|---|---|
| Overcoat | 0.557 Gelatin |
| | 0.002 SURF-1 |
| | 0.002 SURF-2 |
| | 0.204 Silica |
| | 0.17 Polydimethylsiloxane |
| UV | 0.111 UV-1 |
| | 0.019 UV-2 |
| | 0.033 SCV-1 |
| | 0.022 S-1 |

-continued

| Layer | Laydown (g/m$^2$) |
|---|---|
| | 0.022 S-2 |
| | 0.446 Gelatin |
| Cyan | 0.16 Red light sensitive AgX |
| | 0.365 C-1 |
| | 0.362 S-2 |
| | 0.028 S-3 |
| | 0.230 UV-1 |
| | 1.170 Gelatin |
| UV | 0.158 UV-1 |
| | 0.28 UV-2 |
| | 0.046 SCV-1 |
| | 0.032 S-1 |
| | 0.032 S-2 |
| | 0.630 Gelatin |
| Magenta | 0.067 Green-light sensitive AgX |
| | 0.280 C-2 |
| | 0.076 S-2 |
| | 0.033 S-4 |
| | 0.167 ST-1 |
| | 0.019 ST-2 |
| | 0.530 ST-3 |
| | 1.087 Gelatin |
| IL | 0.056 SCV-1 |
| | 0.163 S-2 |
| | 0.650 Gelatin |
| Yellow | 0.186 Blue-light sensitive AgX |
| | 0.42 C-3 |
| | 0.42 P-1 |
| | 0.186 S-2 |
| | 0.10 SCV-2 |
| | 1.133 Gelatin |

Photographic paper support
sublayer 1: resin coat (Titanox and optic brightener in polyethylene)
sublayer 2: paper
sublayer 3: resin coat (polyethylene)

C-1 Butanamide 2-[2,4-bis(1,1-dimethylpropyl)phenoxy]-N-(3,5-dichloro-4-ethyl-2-hydroxyphenyl)

C-2

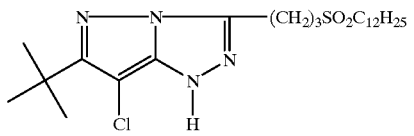

C-3

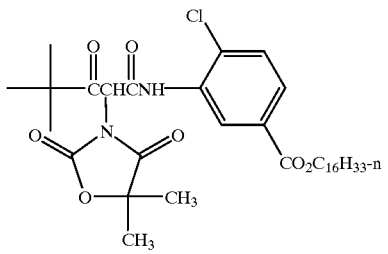

P-1

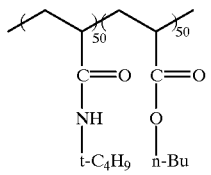

S-1 1,4-Cyclohexylenedimethylene bis(2-ethylhexaneoate)

-continued

S-2

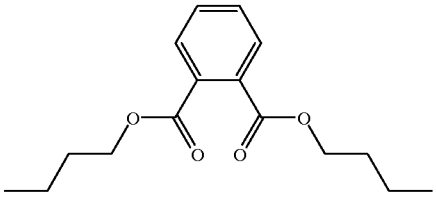

S-3 2-(2-Butoxyethoxy)ethyl acetate

S-4 Di-undecylphthalate

SCV-1

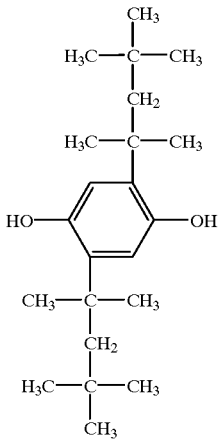

SCV-2 benzenesulfonic acid 2,5-dihydroxy-4-(1-methylheptadecyl)-mono-potassium salt

ST-1

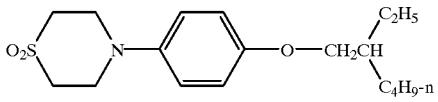

ST-2

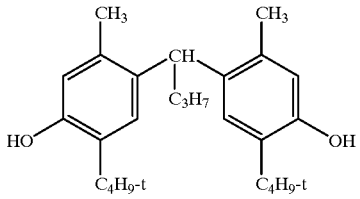

ST-3

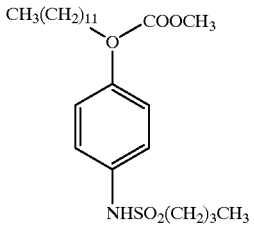

SURF-1

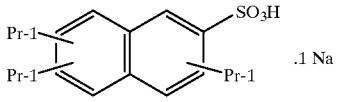

SURF-2 $C_8F_{17}SO_3N(C_2H_5)_4$

-continued

UV-1

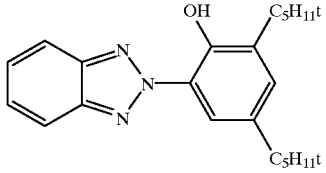

UV-2

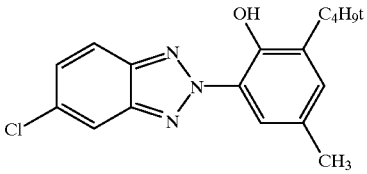

Study of Dye-density Development by RA4 Process

The samples were exposed to 1/10 seconds of daylight of color temperature 3000 K, through 0–3 density step chart in combination with a heat-absorbing filter. After exposure, samples were processed (45 seconds) with the Kodak RA4 process to generate density. The assessment of developability was done by comparing the DlogE curves (at D max) of each unfused color record to the check coating. The percent developability of each color record was calculated by assigning a value of 100 percent to the control. Lower percentages are indicative of slower developability.

Test for Water Resistance

Aqueous solutions of Ponceau Red dye is known to stain gelatin through ionic interaction, therefore it is used to test water resistance of the overcoats. Ponceau Red dye solution was prepared by dissolving 1 gram dye in 1000 grams mixture of acetic acid and water (5 parts:95 parts). Samples in duplicate, without being exposed to light, were processed through the Kodak RA4 process to obtain white D min samples. One of each of these duplicate processed samples was then passed through a set of heated (280° F.) pressurized rollers in order to assess additional benefits from fusing. The water permeability was done by placing a drop of the dye solution on the sample for 10 minutes followed by a 30-second water rinse to removed excess dye solution on the coating surface. Each sample was then air dried, and status A reflectance density on the spotted area was recorded. An optical density of 3, such as for Example No. 1, indicates a completely water permeable coating its water resistance= 0%. Assuming an optical density of 3 (Example No. 1) for 0% water resistance and an optical density of 0 for 100% water resistance, the percent water resistance for a sample is calculated using the following equation.

$$\text{Percent water resistance}=100[1-(\text{status } A \text{ density}/3)]+de$$

EXAMPLE 1–3

One of the urethane-vinyl co-polymers used to demonstrate this invention was a urethane-acrylic copolymer, NeoPac R-9699 from Zeneca Resins (Example 3). The polymer has an acid number of 15. The urethane polymer used to demonstrate the invention was, NeoRez R-9679, a polyurethane from Zeneca Resins having an acid number of 17 (Example 4). For comparison, a check paper as described previously, without the polymer overcoat (Example 1) and the same overcoated with an acrylic polymer, NeoCryl A-5090 (Example 2, acid number 12), also from Zeneca Resins were used. Both polymer overcoats had coverages of approximately 1.08 g/m$^2$.

TABLE 1

| Example | Description (overcoat) | Percent Developability Red | Green | Blue | Silver Retained g/m$^2$ | Percent Water Resistance Unfused | Fused |
|---|---|---|---|---|---|---|---|
| 1 | Check | 100 | 100 | 100 | 0.012 | 0 | 0 |
| 2 | NeoCryl A-5090 | 96.5 | 94.9 | 98 | 0.252 | 100 | 100 |
| 3 | NeoPac R-9699 | 95.3 | 100 | 95 | 0.012 | 97 | 97 |
| 4 | NeoRez R-9679 | 96 | 95 | 96 | 0.01 | 91 | 94 |

It can be seen from Table 1 that although the acrylic overcoat of Example 2 resulted in good developability and water resistance, the retained silver as measured by X-ray fluorescence was unacceptable. This illustrates that acid number alone is inadequate for determining the effectiveness of the polymer. The NeoPac R-9699 urethane-acrylic and the NeoRez R-9679 on the other hand had very little retained silver, showed good developability and water resistance. Thermal yellowing tests done by incubating the samples (Examples 1 and 3) at 75° C./50% RH showed no increase in dye density over the control for the urethane-acrylic overcoat.

EXAMPLE 5–10

The check paper as described above was overcoated with four other urethane-vinyl copolymers, Flexthane 620 from Air Products (acid number of 14), and the urethane-acrylic copolymers, P-1, P-2 and P-3.

TABLE 2

| Example | Description (overcoat) | Polymer coverage g/m$^2$ | Percent water resistance Unfused | Fused | Fingerprint resistance |
|---|---|---|---|---|---|
| 1 | Check paper | 0 | 0 | 0 | Not good |
| 5 | Flexthane 620 | 1.08 | 97 | 97 | Fair |
| 6 | P-1 | 1.08 | 99 | 99 | Good |
| 7 | P-1 | 0.807 | 97 | 97 | Good |
| 8 | P-1 | 0.538 | 94 | 96 | Good |
| 9 | P-2 | 1.08 | 92 | 96 | Good |
| 10 | P-3 | 1.08 | 96 | 97 | Good |

As Table 2 shows, most of the urethane-vinyl copolymers exhibited excellent water resistance after processing both prior to and after fusing. The fingerprint resistance was evaluated by observing the extent to which fingerprints left on the samples for 24 hours was removed by wiping with a tissue. Again the urethane-vinyl overcoats even at 0.538 g/m$^2$ coverage showed superior resistance to fingerprints.

The invention has been described in detail with particular reference to certain preferred embodiments thereof, but it will be understood that variations and modifications can be effected within the spirit and scope of the invention.

What is claimed is:

1. A photographic element comprising:

a support;

at least one silver halide emulsion layer superposed on a side of said support;

a processing solution permeable protective overcoat comprising a urethane-vinyl copolymer having acid functionalities and an acid number of from 5 to 30 overlying said silver halide emulsion layer wherein a weight ratio of a urethane component in the copolymer comprises from 20 to 100 percent and a weight ratio of a vinyl component in the copolymer comprises from 0 to 80 percent.

2. The photographic element of claim 1 further comprising transparent magnetic layer superposed on said support.

3. The photographic element of claim 1 wherein the support comprises polymeric films, papers or glass.

4. The photographic element of claim 1 wherein the support is reflective.

5. The photographic element of claim 1 wherein the overcoat further comprises UV absorbers, surfactants, emulsifiers, coating aids, lubricants, matte particles, rheology modifiers, crosslinking agents, antifoggants, inorganic fillers, pigments, magnetic particles or biocides.

6. The photographic element of claim 1 wherein the urethane-vinyl copolymer having acid functionalities comprises a weight ratio of urethane component:vinyl component of from 4:1 to about 1:4.

7. The photographic element of claim 1 further comprising an antistatic layer superposed on said support.

8. A method of making a photographic element having a developed image comprising:

providing a photographic element comprising a support, a silver halide emulsion layer superposed on a side of said support, a processing solution permeable protective overcoat comprising a urethane-vinyl copolymer having acid functionalities and an acid number of 5 to 30 wherein a weight ratio of a urethane component in the polymer comprises from 20 to 100 percent and a weight ratio of a vinyl component in the polymer comprises from 0 to 80 percent; and imagewise exposing the photographic element to light; and developing the photographic element in a developer solution having a pH greater than 7.

9. The method of making a photographic element of claim 8 further comprising fusing the processing solution permeable overcoat.

10. A photographic element comprising:

a support;

at least one silver halide emulsion layer superposed on a side of said support;

a processing solution permeable protective continuous overcoat comprising a urethane-vinyl copolymer having acid functionalities overlying said silver halide emulsion layer wherein a weight ratio of a urethane component in the copolymer comprises from 20 to 100 percent and a weight ratio of a vinyl component in the copolymer comprises from 0 to 80 percent and wherein the weight ratio of urethane component:vinyl component is from about 4:1 to about 1:4.

11. The photographic element of claim 10 wherein the overcoat further comprises a crosslinking agent.

* * * * *